US006027765A

United States Patent [19]

Kaneko

[11] Patent Number: 6,027,765

[45] **Date of Patent: *Feb. 22, 2000**

[54] CONTINUOUS CERAMIC COMPOSITE PLATING METHOD AND APPARATUS FOR LONG DOCTOR BASE MATERIALS

[75] Inventor: Mitsuru Kaneko, Tokyo, Japan

[73] Assignee: Nihon New Chrome Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,246

[22] Filed: Nov. 4, 1997

[30] Foreign Application Priority Data

Apr. 2, 1997 [JP] Japan ..... 9-083745

[51] Int. Cl.[7] ..... B05D 3/12

[52] U.S. Cl. ..... 427/178; 427/305; 427/372.2; 427/434.2; 427/438

[58] Field of Search ..... 427/178, 305, 427/372.2, 434.2, 438, 443.1; 118/400

[56] References Cited

U.S. PATENT DOCUMENTS 3,753,667 8/1973 Metzger et al. .
3,988,518 10/1976 McGrath ..... 427/436

FOREIGN PATENT DOCUMENTS 02104696 4/1990 Japan .
70343 3/1992 Japan .
08118586 5/1996 Japan .
2 164 062 3/1986 United Kingdom .

OTHER PUBLICATIONS

English Translation of the European Search Report EP 98 30 0918.

*Primary Examiner*—Brian K. Talbot
*Attorney, Agent, or Firm*—Dennis G. LaPointe; Mason & Assoc., P.A.

[57] ABSTRACT

A continuous ceramic composite plating method for long doctor base materials which comprises a degreasing step, rinsing step, acid immersion step, rinsing step, electroless ceramic composite nickel plating step, plating solution collection step, rinsing step, and drying step between a first step of supplying continuously one or a plurality of long doctor blade base materials held on one or a plurality of material reels spirally while the blade surfaces are maintained in a horizontal direction with respect to the surface of a solution; and a predetermined interval therebetween is maintained and a final step of taking up continuously the one or plurality of blade base materials on a plurality of corresponding take-up reels while the one or plurality of blade base materials are cramped by a plurality of pinch rolls, as well as an apparatus therefor. The doctor blades can be plated continuously and efficiently. The obtained product is not curled and has abrasion resistance and durability because ceramic fine powder are deposited on the effective surface of the blade efficiently in a high concentration. Since no spacer is used, the blade has good outer appearance and excellent corrosion properties.

4 Claims, 4 Drawing Sheets

CONTINUOUS CERAMIC COMPOSITE PLATING METHOD AND APPARATUS FOR LONG DOCTOR BASE MATERIALS

BACKGROUND OF THE INVENTION

1. Field of the Invention

The present invention relates to a method of plating a doctor blade. More specifically, the present invention relates to an efficient continuous plating method for doctor blades especially used for gravure (intaglio) printing, which provides the doctor blades having a coat excellent in abrasion resistance, and the present invention also relates to an apparatus therefor.

2. Description of the Related Art

In gravure (intaglio) printing, ink adhered to a non-image portion of a plate barrel is scraped away while a doctor blade is pressed against the circumferential surface of the plate barrel by a predetermined pressure. The doctor blade removes the ink on the non-image portion completely and has a function to leave a predetermined amount of ink on an image portion. Accordingly, the contact pressure between the plate barrel and the doctor blade must be always maintained at a predetermined level and a distal end portion of the doctor blade is required to have abrasion resistance.

One of methods for providing abrasion resistance to the distal end portion of the doctor blade is to form a ceramic plating layer on that portion.

This method is comprised of: adding an appropriate amount of ceramic fine powder such as silicon carbide or boron nitride to an electroless nickel bath or electric nickel bath; plating under agitation; depositing and compounding these fine powder into a plating film simultaneously with the plating; and baking the plating film as required to form a hard layer on the surface of the doctor blade.

The size of the doctor blade to be installed in a printing machine conforms to the width of a roll of the plate barrel (such as 50, 90, 120 or 400 cm). The width of the blade itself is, for example, 45, 50 or 60 mm. To carry out composite plating on these blades efficiently, a belt-like steel base material has been directly plated under a state rolled in a roll shape through a spacer (such as a steel material) that does not affect an edge portion of the blade. Thereafter, the roll of the base material has been unrolled and cut to a predetermined length to obtain a doctor blade (Japanese Patent Application Laid-open No. Hei 4-70343).

This method has the following problems:

(1) Since the spacer is used, the marks of an unplated spacer portion are left behind as a net pattern, thereby impairing the outer appearance of a product, and the product has a durability problem because the unplated portion is easy to rust;

(2) Since plating is carried out in a state that the base material is rolled, a forming effect at the time of plating remains when the base material is unrolled after plating. Therefore, a slightly curled product is obtained, a blade obtained by cutting the base material to a predetermined length has a slight warp (deformation), and contact pressure to a printing roll at both end portions is slightly different from contact pressure at a central portion. As a result, a locally abnormal weight loss is induced and printing cannot be made satisfactorily;

(3) Since the base material wound spirally is pre-treated, plated and post-treated as a set, generally, the production of doctor blade may only be made manually in the batch manner. Therefore, the mass-production of the doctor blade requires much labor. Further, an examination that secures removal of ceramic fine powder adhered to the edge of the blade and the step of polishing the edge of the blade both of which are carried out before the shipment of products must be carried out separately from a plating step; and (4) Since not only the edge of the blade which is required functionally but also other portions of the doctor blade are uniformly plated, the consumption of an expensive chemical is large, thereby presenting a cost problem.

SUMMARY OF THE INVENTION

The inventor of the present invention has made an intensive study to overcome the above problems in the ceramic plating of a doctor blade of the prior art and has accomplished the present invention.

It is therefore an object of the present invention to provide a method of plating the doctor blade and an apparatus therefor which overcome the above problems in the ceramic plating of the doctor blade.

In other words, the present invention provides a continuous ceramic composite plating method for long doctor base materials and an apparatus therefor, having the following constitutions.

1) A continuous ceramic composite plating method for long doctor base materials is characterized by comprising a degreasing step, rinsing step, acid immersion step, rinsing step, electroless ceramic composite nickel plating step, plating solution collection step, rinsing step, and drying step between a first step of supplying continuously a long doctor blade base material (2) held on a material reel (1) spirally while the blade surface is maintained in a horizontal direction with respect to the surface of a solution and a final step of taking up continuously the blade base material (2) on a corresponding take-up reel (30) while the blade base material (2) is cramped by a plurality of pinch rolls (20).

2) A continuous ceramic composite plating method for long doctor base materials is characterized by comprising a degreasing step, rinsing step, acid immersion step, rinsing step, electroless ceramic composite nickel plating step, plating solution collection step, rinsing step, and drying step between a first step of supplying continuously a plurality of long doctor blade base materials (2*a*, 2*b*, 2*c*) held on a plurality of material reels (1*a*, 1*b*, 1*c*) spirally while the blade surfaces are maintained in a horizontal direction with respect to the surface of a solution, and a predetermined interval therebetween is maintained and a final step of taking up continuously the plurality of doctor blade base materials (2*a*, 2*b*, 2*c*) on a plurality of corresponding take-up reels (30*a*, 30*b*, 30*c*) while the plurality of blade base materials (2*a*, 2*b*, 2*c*) are cramped by a plurality of pinch rolls (20).

3) The continuous ceramic composite plating method described in the above item 1) or 2) is characterized in that the doctor blade base materials are of a double-edged type, supplied from the material reels with a central portion other than both edge portions masked in a belt form, and taken up on take-up reels.

4) A continuous ceramic composite plating method for long doctor base materials is characterized by comprising letting out the long doctor base materials plated by the method described in any one of the above items 1) to 3) from the take-up reels, straightening out and baking the long doctor base materials by passing through a heating furnace.

5) A continuous ceramic composite plating apparatus for long doctor base materials, including one or a plurality of material reels (1 or 1*a*, 1*b*, 1*c*) for holding one or a plurality of long blade base materials (2 or 2*a*, 2*b*, 2*c*) spirally, a plurality of pinch rolls (20) for cramping and forwardly supplying the one or plurality of blade base materials continuously while the blade surface(s) of the one or plurality of blade base materials are maintained in a horizontal direction with respect to the surface of a solution and a predetermined interval therebetween is maintained, the same number of take-up reels (30 or 30*a*, 30*b*, 30*c*) for taking up the one or plurality of blades continuously, is characterized by comprising a degreasing tank (3), rinsing tank (4), acid immersion tank (5), rinsing tank (6), electroless ceramic composite nickel plating tank (7), plating solution collecting tank (8), rinsing tank (9), and drying tank (10) between the material reels and the take-up reels.

6) The doctor blade plating apparatus described in the above item 5) is characterized in that a space tank (12) is disposed between the respective treatment tanks, and a partition plate having a slit portion (14) through which a single blade can pass or a plurality of parallel slit portions (14*a*, 14*b*, 14*c*) through which a plurality of blades can pass with maintaining a predetermined interval therebetween is used to separate each treatment tank from each space tank.

7) An apparatus for continuously producing baked long doctor materials is characterized by comprising a plurality of pinch rolls (20) for continuously forwardly straightening out long doctor materials plated by the method described in the above item 1) or 2), from the take-up reel and a straightening furnace for baking through which the straightened plated blades pass.

BRIEF DESCRIPTION OF THE DRAWINGS

The above and other objects and advantages of this invention will become clear from the following description with reference to the accompanying drawings, in which.

DETAILED DESCRIPTION OF THE INVENTION

The present invention is described below in detail with reference to the accompanying drawings.

Figure 1:
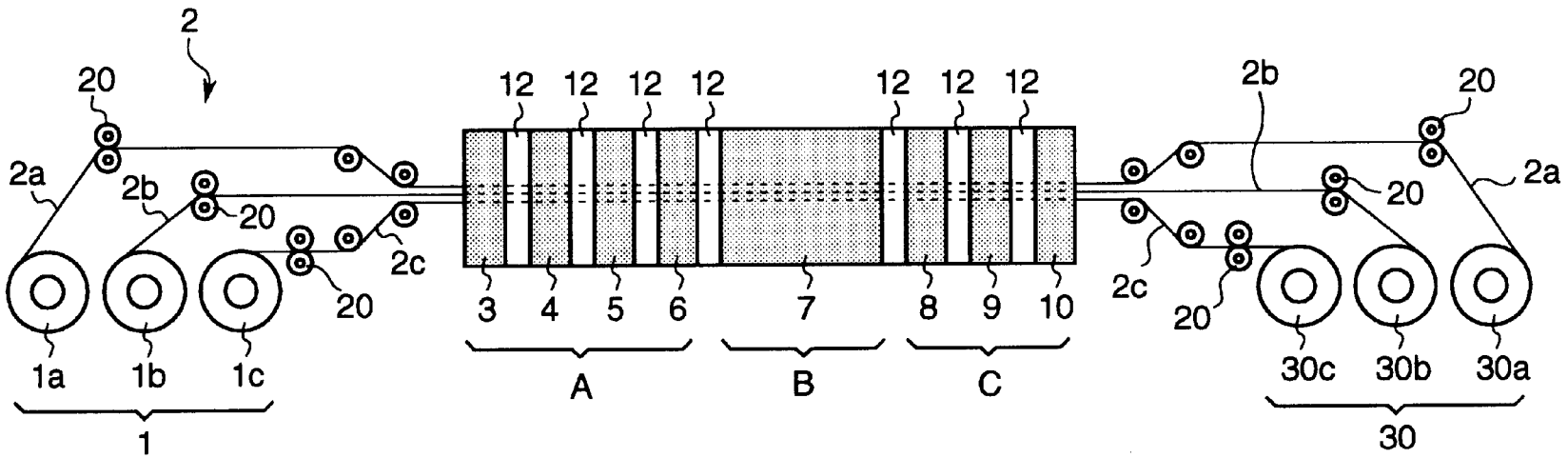
FIG. 1 is a side view showing an outline of a plating apparatus according to the present invention.

FIG. 1 is a side view showing an outline of one example of a plating apparatus for carrying out a doctor blade plating method according to the present invention. The apparatus shown in FIG. 1 plates three long doctor blade base materials at the same time. According to the present invention, the number of long base materials to be plated at the same time is not limited to 3 and may be 4 or more, or only one.

In FIG. 1, reference numeral 1 (1*a*, 1*b*, 1*c*) denotes a material reel for holding a long doctor blade base material 2 (2*a*, 2*b*, 2*c*) in a spiral form. The doctor blade base material 2 is forwardly supplied while being cramped by a plurality of pinch rolls (20) provided between the respective treatment tanks (described later), treated in a pre-treatment process A, a composite plating process B and a post-treatment process C, and taken up by means of a take-up reel 30 (30*a*, 30*b*, 30*c*). The running speed (processing speed) of the doctor blade base material 2 is adjusted by the take-up speed of the take-up reel (30).

In the present invention, it is necessary to forward the doctor blade base material (2) with the blade surface maintained in a horizontal direction with respect to the surface of a solution and let it pass through each treatment tank.

The pre-treatment process A provided between the material reel (1) and the composite plating process B consists of a degreasing step, rinsing step, acid immersion step and rinsing step, and a degreasing tank (3), rinsing tank (4), acid immersion tank (5) and rinsing tank (6) are provided for the corresponding respective steps. Also, the post-treatment process C provided between the composite plating process B and the take-up reel (30) includes a plating solution collection step, rinsing step and drying step, and a plating solution collection tank (8), rinsing tank (9) and drying tank (10) are provided for the corresponding respective steps, similarly. These treatment tanks are arranged in series so that the pre-treatment, composite plating and post-treatment are carried out continuously.

Figure 2:
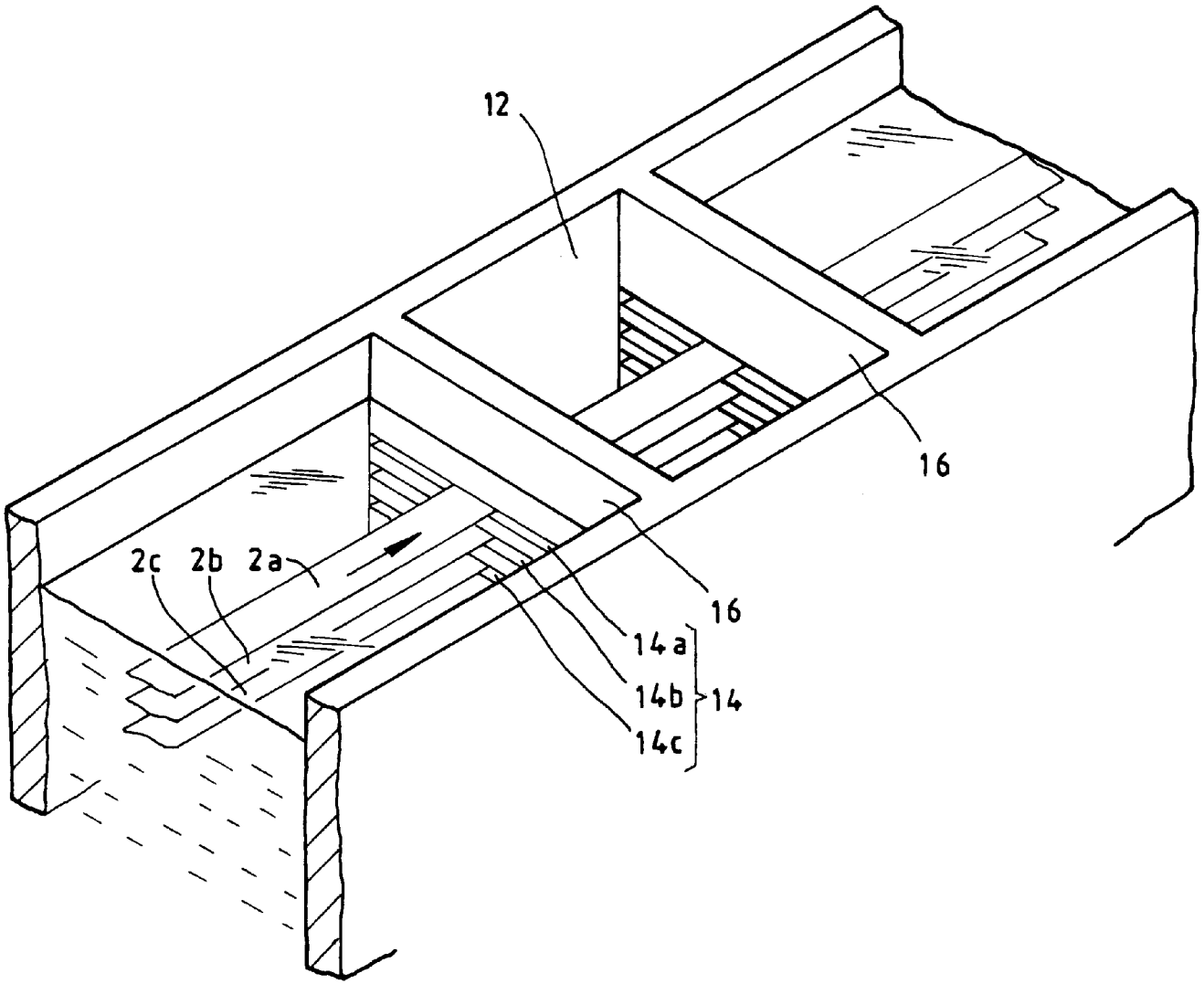
FIG. 2 is a perspective view of slit portions for separating each treatment tank from each space tank in the plating apparatus of the present invention.

Further, a space tank (12) is provided between the respective treatment tanks. The respective treatment tanks and space tanks are separated by a partition plate (16) having a slit portion 14 (14*a*, 14*b*, 14*c*) through which the blade can pass as shown in the perspective view of FIG. 2. A slight amount of a pre-treatment solution (degreasing chemical, acidic solution, plating solution) or a slight amount of a post-treatment solution (rinsing solution) flows into the space tank through the opening of the slit. However, these solutions are removed from an outlet (not shown) in a lower portion of each space tank and recycled to the respective treatment tanks as required. The material constituting each tank and partition plate has resistance to the process solutions and any materials known in this field conventionally (such as hard vinyl chloride and acrylic resins and the like) may be used without restriction.

As the degreasing process which is carried out in the degreasing tank as the pre-treatment process A, electrolytic degreasing, alkali degreasing or the like may be employed. In the case of electrolytic degreasing, grease adhered to the surface of the base material is removed using a commercially available electrolyte for degreasing (for example, a 50 g/l solution of the Ace Clean 5300 of Okuno Seiyaku Kogyo Co.) at a temperature of 30° C. and a current density of −5 A/dm$^2$ for about 3 minutes, for example. In the case of alkali degreasing, grease adhered to the surface of the base material is removed by passing the base material through a commercially available alkali solution (for example, the Pakuna RT-23 of Yuken Kogyo Co.) at around 50° C. for 5 minutes.

After rinsing in the rinsing tank (4), the base material is immersed in the acid immersion solution tank (5) containing hydrochloric acid having a concentration of 5 to 10%, for example, at room temperature for 3 to 5 minutes.

After immersion in an acid, the base material blade cleaned in the rinsing tank (6) is plated in the composite plating tank. The plating is generally conducted through an electroless ceramic composite nickel plating. However, electric composite plating can be carried out as the case may be. The electroless ceramic composite nickel plating is plating that is carried out under agitation by dispersing ceramic fine powder such as silicon carbide or boron nitride into an electroless nickel plating solution and jetting the solution.

The ceramic fine powder is deposited and compounded into a plating film, whereby a plating film having excellent abrasion resistance and durability can be obtained.

The composite plating process of the method according to the present invention is characterized in that the base material is allowed to pass through the plating tank while it is held in a horizontal direction, a plating solution is stirred by jetting to disperse ceramic fine powder uniformly into the plating solution, and the ceramic fine powder deposited on the top surface of the base material blade is caused to be present in a higher concentration than the ceramic fine powder deposited on the under surface of the base material blade using a gravitation function. Thus, the obtained plated blade is used such that the side of a distal end portion thereof having a high concentration of the ceramic fine powder is in contact with a printing roll.

Figure 3:
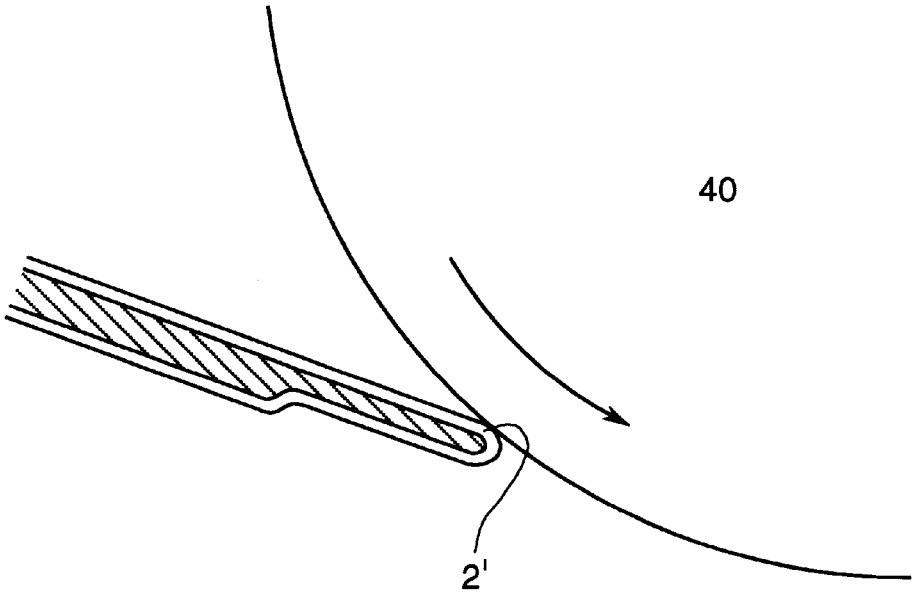
FIG. 3 is a schematic sectional view showing a contact state between a distal end portion of a plated blade and a plate barrel according to a method of the present invention.

In other words, a contact state between the distal end portion of the blade plated by the method of the present invention and a plate barrel is such as shown in FIG. 3 that the distal end portion 2' having a high concentration of ceramic fine powder, abrasion resistance and durability is in contact with the plate barrel 40.

According to the present invention, as an electroless ceramic composite nickel plating solution, the following composition is employed.

| | |
|---|---|
| $NiSO_4 \cdot 6H_2O$ | 24 g/liter |
| DL malic acid | 20 g/liter |
| soda succinate | 40 g/liter |
| lead acetate | 0.002 g/liter |
| soda hypophosphate | 25 g/liter |
| SiC (average diameter of 0.5 $\mu$m) | 10 g/liter |
| caustic soda | amount as to obtain pH of 5.0 |

In the present invention, portions where plating are unnecessary in the blade base material, that is, a central portion and a rear end portion other than an edge portion (about 5 mm) for a single-edged blade and a central portion for a double-edged blade are masked in the form of a belt and plated, thereby making it possible to further reduce the consumption of the ceramic fine powder. In this case, the masked portions are subjected to a special rust-proofing treatment (such as treatment with a phosphate), thereby making it possible to increase a product value.

Masking means is not particularly limited but masking may be carried out by affixing silicone rubber to a portion to be masked in a belt form or affixing masking tape.

The plating solution collection tank (8) is provided right after the plating solution tank (7) so that the plating solution collected is recycled to the plating tank from a lower portion thereof.

The plated blade cleaned in the rinsing tank (9) is dried with hot air (50 to 150° C. ) in the drying tank (10).

A polishing machine for removing foreign matters adhered to the distal end portion of the blade may be provided between the drying tank (10) and the product take-up reel (30) to polish the edge of the blade continuously. This polishing may be carried out after baking.

Baking is carried out by straightening out the base material blade and supplying it to a straightening furnace after the base material blade is taken up on the take-up reel. The hardness of the blade is improved by this baking. As baking conditions, for example, a temperature of 100 to 400° C. and a time of 0.5 to 3 hours may be employed.

After baking, the blade is graduated at predetermined intervals (for example, every 5 cm) in a lengthwise direction of the blade by a graduating machine, and shipped directly or by cutting as required.

Incidentally, after the completion of the post-treatment process, baking and polishing are carried out without taking up the blade to obtain a product directly or by cutting.

Figure 4A:
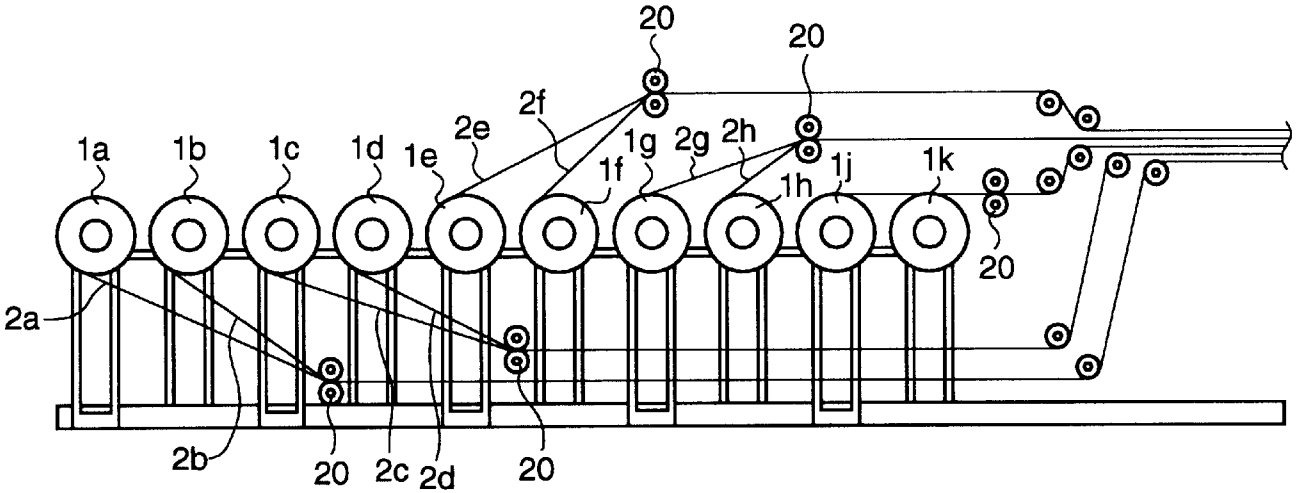
FIG. 4A is a side view showing an example of material reel portions of the apparatus of the present invention.
Figure 4B:
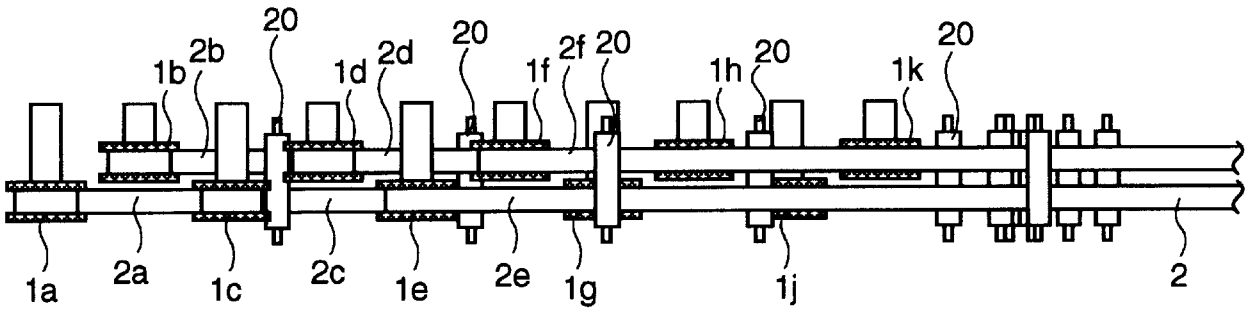
FIG. 4B is a plan view thereof.

The apparatus described above (FIG. 1) has three material reels to treat 3 blade base materials at the same time, but can treat, for example, 10 blade base materials at the same time. Stated more specifically, as shown in FIG. 4A and FIG. 4B which are a schematic side view and a schematic plane view of the material reels and the base materials supplied from the reels, respectively, by using 5 material reels (1*a* to 1*k*) arranged in a zigzag form in a horizontal direction, 10 blade base materials (2*a* to 2*k*) can be treated at the same time.

According to the doctor blade plating method of the present invention described above, plating pre-treatment (alkali degreasing step, rinsing step, acid immersion step, and rinsing step), composite plating, plating post-treatment (rinsing step, drying step, and surface polishing step) processes can be carried out continuously. Furthermore, the examination and polishing of the edge of the blade which have been separate steps in the prior art can be incorporated into the method, thereby greatly improving plating efficiency, and being capable of labor saving and the mass-production of the blade with ease. Since these treatment processes are arranged in series, the obtained product is free from deformation such as curling and from a locally abnormal weight loss and has excellent printing properties.

Further, since composite plating is carried out while the doctor blade base material is held in a horizontal direction, it is possible to cause ceramic fine powder to deposit on the effective surface of the blade efficiently in a high concentration, thereby providing excellent abrasion resistance and durability to the blade economically. Furthermore, since portions not to be plated of the blade base material are masked and plated, the consumption of the fine powder can be reduced. In this case, when the masked portions are subjected to a special rust-proofing treatment, the product value can be increased.

Furthermore, the product obtained by the present invention has excellent outer appearance and an excellent product value without the marks of a spacer left on the surface of the product because the spacer is not used unlike the plating method of the prior art as well as improved durability with excellent corrosion resistance.

BEST MODE FOR CARRYING OUT THE INVENTION

The following examples are given to specifically describe the effect of the method of the present invention.

Claimed Method

Using an apparatus of the present invention having 7 material reels, electrolytic degreasing step, rinsing step, acid immersion step, rinsing step, composite plating step, rinsing step and drying step were carried out sequentially to treat doctor blade base materials. The base materials were electrolyzed at a temperature of 30° C. and a current density of −5 A/dm$^2$ for 3 minutes using a 50 g/l solution of the Ace Clean 5300 of Okuno Seiyaku Kogyo Co. as the electrolytic degreasing step. The base materials were rinsed in 5% hydrochloric acid for 3 minutes as the acid immersion step and plated at 85° C. for 60 minutes using the Composite Shoomer SC-80 (SC-80-1: 200 ml/l, SC-80-2: 20 ml/l; Nippon Kanizen Co.) as the composite plating step. The interval of the seven base materials was 20 mm and the plating speed was 10 m/hr. After plating, the seven plated blades were measured for the thicknesses of their plating films at 6 locations and the results (average value) are shown in Table 1. When both front and rear surfaces of each blade were observed through a microscope, the marked adhesion of SiC was observed on the front surface rather than the rear surface. After the deformation of the blade (fourth blade) at the center was further observed visually, the blade was cut, a picture of the cross section of the blade was taken by an (electron) microscope, the contents (VOL %) of SiC contained in the plating film on the effective surface and the rear surface were obtained from the photomicrograph, and the presence of rust after 80 minutes of immersion in 5% of salt water was checked. The results are shown in Table 2.

Conventional Method

A doctor blade base material was wound spirally using an SUS metal net spacer and the same electrolytic degreasing step, rinsing step, acid immersion step, rinsing step, composite plating step, rinsing step and drying step as described above were carried out sequentially in a batch manner to process the doctor blade base material. The deformation, the contents of ceramic fine powder (SiC) on front and rear surfaces, and rust prevention properties were measured and evaluated in the same manner as described above. The results are also shown in Table 2.

TABLE 1

| | average thickness of plating film ($\mu$m) | |
|---|---|---|
| | front surface | rear surface |
| first blade from the top | 9.50 | 9.43 |
| second blade from the top | 9.57 | 9.63 |
| third blade from the top | 10.13 | 10.20 |
| fourth blade from the top | 10.63 | 10.57 |
| fifth blade from the top | 10.10 | 10.13 |
| sixth blade from the top | 9.80 | 10.20 |
| seventh blade from the top | 10.40 | 10.57 |

TABLE 2

| | claimed method | conventional method |
|---|---|---|
| deformation | no | slightly curled |
| content of SiC fine powder | | |
| effective surface | 25 vol % | 15 vol % |
| rear surface | 8 vol % | 15 vol % |
| corrosion prevention | no corrosion | portion having contact mark is corroded |
| spacer properties | | |

What is claimed is:

1. A continuous ceramic composite plating method for long doctor base materials comprising: a degreasing step; rinsing step, acid immersion; rinsing step; electroless ceramic composite nickel plating step; plating solution collection step; rinsing step; and drying step between a first step of supplying continuously a long doctor blade base material held on a material reel spirally while the blade surface is maintained in a horizontal direction with respect to the surface of the solutions, for uniformly plating the long doctor blade material wherein a higher concentration of a ceramic fine powder is deposited on a top surface of the long doctor blade material than a concentration of the ceramic fine powder deposited on the lower surface of the long doctor blade material, and a final step of taking up continuously the blade base material on a corresponding take-up reel while the blade base material is cramped by a plurality of pinch rolls.

2. A continuous ceramic composite plating method for long doctor base materials comprising: a degreasing step; rinsing step, acid immersion; rinsing step; electroless ceramic composite nickel plating step; plating solution collection step; rinsing step; and drying step between a first step of supplying continuously a plurality of long doctor blade base materials held on a plurality of material reels spirally while the blade surfaces are maintained in a horizontal direction with respect to the surface of the solution and a predetermined interval therebetween is maintained, for uniformly plating the plurality of long doctor blade materials wherein a higher concentration of a ceramic fine powder is deposited on a top surface of each of the plurality of long doctor blade materials than a concentration of the ceramic fine powder deposited on the lower surface of each of the plurality of long doctor blade materials, and a final step of taking up continuously the plurality of doctor blade base materials on a plurality of corresponding take-up reels while the plurality of blade base materials are cramped by a plurality of pinch rolls.

3. The continuous ceramic composite plating method according to claim 1 or 2, wherein the doctor blade base materials are double-edged, supplied from the material reels with a central portion other than both edge portions masked in a belt form, and taken up on take-up reels.

4. A continuous ceramic composite plating method for long doctor base materials comprising: letting out the long doctor base materials plated by the method according to any one of claims 1 to 3 from the take-up reels, straightening out and baking the long doctor base materials by passing through a heating furnace.

* * * * *

UNITED STATES PATENT AND TRADEMARK OFFICE

CERTIFICATE OF CORRECTION

PATENT NO. : 6,027,765

DATED : February 22, 2000

INVENTOR(S) : Mitsuru Kaneko

It is certified that error appears in the above-identified patent and that said Letters Patent is hereby corrected as shown below:

Col. 8, line 10
replace "solutions,"
with --solution,--.

Signed and Sealed this

Twelfth Day of December, 2000

*Attest:*

Q. TODD DICKINSON

*Attesting Officer*

*Director of Patents and Trademarks*